US007314259B2

(12) United States Patent
Fujinaga

(10) Patent No.: US 7,314,259 B2
(45) Date of Patent: Jan. 1, 2008

(54) IMAGE PROCESSING APPARATUS AND DISPLAY CONTROL METHOD FOR IMAGE PROCESSING APPARATUS

(75) Inventor: Seiya Fujinaga, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 359 days.

(21) Appl. No.: 10/943,842

(22) Filed: Sep. 20, 2004

(65) Prior Publication Data

US 2005/0094177 A1 May 5, 2005

(30) Foreign Application Priority Data

Sep. 24, 2003 (JP) ..... 2003-332506

(51) Int. Cl.
*B41J 3/00* (2006.01)

(52) U.S. Cl. ..... 347/2; 347/3; 347/7

(58) Field of Classification Search ..... 347/2, 347/7, 86, 3, 5, 9, 19; 358/1.1
See application file for complete search history.

(56) References Cited

U.S. PATENT DOCUMENTS

| | | | | |
|---|---|---|---|---|
| 4,845,526 | A | 7/1989 | Ito | |
| 5,315,317 | A | 5/1994 | Terasawa et al. | |
| 5,822,076 | A | 10/1998 | Maruyama | |
| 6,056,386 | A | 5/2000 | Nohata et al. | |
| 6,454,381 | B1 | 9/2002 | Olsen et al. | |
| 2004/0041856 | A1* | 3/2004 | Im et al. | 347/7 |
| 2004/0130732 | A1* | 7/2004 | Denpo | 358/1.1 |

FOREIGN PATENT DOCUMENTS

| | | |
|---|---|---|
| JP | 62-011875 | 1/1987 |
| JP | 1-195049 | 8/1989 |
| JP | 3-32851 | 2/1991 |
| JP | 07-325654 | 12/1995 |
| JP | 9-94981 | 4/1997 |
| JP | 9-98245 | 4/1997 |
| JP | 10-86399 | 4/1998 |
| JP | 10-228213 | 8/1998 |
| JP | 2003-244353 | 8/2003 |

OTHER PUBLICATIONS

Partial English translation of JP 10-228213.

* cited by examiner

*Primary Examiner*—Lam Son Nguyen
(74) *Attorney, Agent, or Firm*—Fitzpatrick, Cella, Harper & Scinto

(57) ABSTRACT

In the image processing apparatus and display control method, a user can know a residual ink amount by a simple operation and hardware, such as a particular switch for displaying the residual ink amount, is not required. The image processing apparatus includes a mode switch which executes switching among plural modes, each having a standby state, a set mode storage unit which stores a set mode, a display which displays a mode set in the set mode storage unit, a printing unit which prints data such as an image or text, a residual ink amount detection unit which detects a residual ink amount, and a display control unit which causes the display to display the set mode and the residual ink amount detected by the ink amount detection unit when the mode switch switches the mode.

4 Claims, 5 Drawing Sheets

IMAGE PROCESSING APPARATUS AND DISPLAY CONTROL METHOD FOR IMAGE PROCESSING APPARATUS

BACKGROUND OF THE INVENTION

1. Field of the Invention

The present invention relates to an image processing apparatus and a display control method for an image processing apparatus.

2. Related Background Art

Digital cameras, that are becoming rapidly popular, have been regarded as a peripheral device for a personal computer, but are now sold also to users not having the personal computers. For this reason, there is an increasing demand for printing data of a digital camera by a home-use printer or the like without utilizing a personal computer.

Data obtained with a digital camera are stored in a memory card such as an SD card or a compact flash memory (registered trade mark). In case a personal computer is available at home, the image data can be fetched in the personal computer and printed by a recording apparatus such as a printer.

On the other hand, a user not having a personal computer can employ a method, for direct printing without the personal computer, of directly inserting a media such as a memory card storing the digital image into a recording apparatus and printing a photograph image by an operation from an operation unit of the apparatus. Therefore the demand for printing photographic image at home and the printing demand at home are increasing.

Also various low-end printers for home use are now being commercialized. For such low-end printers, various printing apparatuses including ink jet technology are commercialized. In such ink jet technology, the printing is achieved by an ink, and, when the ink is exhausted, a residual ink amount is displayed to the user thereby requesting the replacement of the ink.

Along with an increase in the printing demand at home, the printing demand is increasing also in low-end composite apparatuses and printers, so that the ink consumption as well as the frequency of ink replacement by the user are both increasing. Therefore, it is necessary to inform the user of the information on ink exhaustion in a more easily understandable manner.

A state of a low residual ink amount is often encountered particularly in low-end apparatus, so that an indication of the residual ink amount is considered essential in order that the user can execute a printing operation without stress.

For indicating the residual ink amount, various methods have already been proposed. Prior methods for displaying the residual ink amount include a method of detecting the residual ink amount and displaying such residual ink amount (for example, cf. Japanese Patent Application Laid-open No. H1-195049) and a method of displaying plural residual ink amounts on a single display portion (for example, cf. Japanese Patent Application Laid-open No. H3-32851).

For such display, various means are required for providing a correct value, since evaporation, etc., of the ink has to be considered, for example, in an ink jet apparatus. It is quite common to directly indicate detected information of the residual ink amount, but there is also known a method of also adding information on the frequency of use of the ink, and displaying a low level of the residual ink amount when the ink is exhausted in consideration of the residual ink amount and the frequency of use (for example, cf. Japanese Patent Application Laid-open No. H10-86399).

There is also known a method of mounting a sensor for detecting the residual ink amount and displaying the residual ink amount to the user when a low residual ink amount is recognized, based on the information detected by the sensor (for example, cf. Japanese Patent Application Laid-open Nos. H9-98245 and H9-94981).

In the prior examples mentioned above, however, the low-end composite apparatus, the printer, etc., are required to reduce the cost as much as possible because of a severe price competition, so that a sufficient cost cannot be used for the display of the residual ink amount.

On the other hand, it is required to inform the user of the residual ink amount also in such a reduced-cost image processing apparatus by way of the display or the apparatus.

SUMMARY OF THE INVENTION

An object of the present invention is to provide an image processing apparatus in which the user can know a residual ink amount by a simple operation and which does not require a hardware such as a particular switch for displaying the residual ink amount, and a display control method for such image processing apparatus.

DESCRIPTION OF THE PREFERRED EMBODIMENTS

The best mode for carrying out the invention is described with regard to the following embodiments.

Embodiment 1

Figure 1:
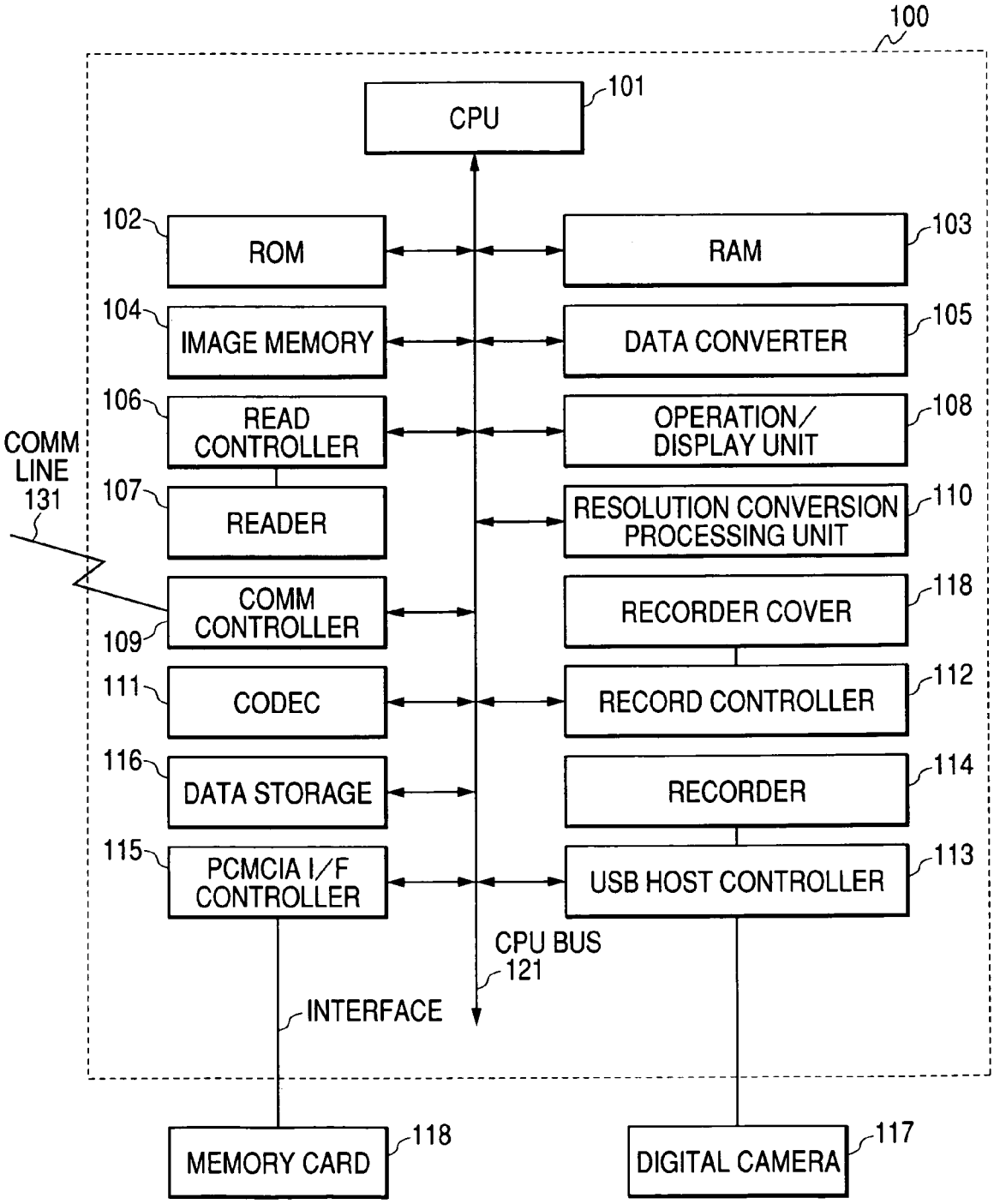
FIG. 1 is a block diagram schematically showing an image processing apparatus 100 constituting an embodiment 1 of the present invention.

FIG. 1 is a block diagram schematically showing a configuration of an image processing apparatus 100 constituting an embodiment 1 of the present invention.

The image processing apparatus 100 is provided with a CPU 101, a ROM 102, a RAM 103, an image memory 104, a data converter 105, a read controller 106, a reader 107, an operation/display unit 108, a communication controller 109, a resolution conversion unit 110, a codec 111, a record controller 112, a USB host controller 113, a recorder 114, a PCMCIA I/F controller 115, a data storage 116, a digital camera 117, a memory card 118, and a CPU bus 121.

The CPU 101 is a system controlling unit and controls the entire image processing apparatus 100.

The ROM 102 stores a control program to be executed by the CPU 101, an incorporated operating system (OS) program, etc. In this embodiment, control programs stored in the ROM 102 execute a software control such as scheduling or task switch under the management of the incorporated OS stored in the ROM 102.

The RAM 103 is constituted of an SRAM (static RAM) or the like, which stores program control variables, set values registered by the operator and management data for the image processing apparatus, and is provided with various work buffer areas.

The image memory 104 is constituted of a DRAM (dynamic RAM) and stores image data.

The data converter 105 executes image data conversion such as an analysis of page description language (PDL) and CG (computer graphics) development of character data.

The read controller 106 subjects an image signal, obtained from the reader 107 by optically reading of an original by a CIS (contact image sensor) and conversion to electrical image data, to various image processings such as a digitization or a halftone process through an unillustrated image processing controller, thereby outputting high-definition image data. In the embodiment mentioned above, the read controller 106 can execute both a sheet reading control in which the original is read while it is conveyed and a book reading control in which an original placed on an original table is scanned.

The operation/display unit 108 is constituted of (1) an operation unit provided with numeral input keys, character input keys, one-touch telephone number keys, mode setting keys, a determination key, a cancel key, etc., for executing a determination of image transmission destination data, and a registration of set data and an energy saving mode, and (2) a display unit constituted of various keys, LED (light emitting diode), an LCD (liquid crystal display), etc., for displaying various input operations by the operator, an operation status and other status of the image processing apparatus 100.

The communication controller 109 is constituted of a MODEM (modulation-demodulation apparatus), an NCU (network control unit), etc., and is connected to an analog communication line (PSTN) 131, thereby executing a communication control by T30 protocol and a line control such as a call sending and a call reception with the communication line.

The resolution converter 110 executes a resolution converting control such as a millimeter-inch conversion for the image data. The resolution converter 110 can also execute an enlargement and a reduction of the image data.

The CODEC 111 executes an encoding/decoding process on the image data (MH, MR, MMR, JBIG, JPEG, etc.) handled in the image processing apparatus 100, and also executes an enlarging/reducing process.

The recording controller 112 executes, through an unillustrated image processing controller, various image processings such as a smoothing process, a recording density correcting process, a color correction, etc., on the image data to be printed for conversion into high-definition image data for supply to the PCMCIA I/F controller 115 (to be explained later). It also controls the PCMCIA I/F controller 115 for periodically acquiring state information of the recorder 114.

The recorder 114 is a printing apparatus constituted, for example, of a laser beam printer or an ink jet printer, for printing color image data or monochromatic image data on a printing material. It communicates with the USB controller 113 with a protocol determined in the USB communication standard, in which the recorder 114 serves as a function.

The USB controller 113 executes a communication according to the protocol determined in the USB communication standard. The USB communication standard enables a high-speed bi-directional communication, in which plural hubs or functions (slaves) can be connected to a single host (master). The USB controller 113 serves as a master in the USB communication.

The PCMCIA I/F controller 115 for communication control of the USB interface executes a protocol control according to the USB communication standard, thereby converting data from a USB control task that is executed by the CPU 101, into a packet for a USB packet transmission to an external information processing terminal, and converting a USB packet from the external information processing terminal into data for transmission to the CPU 101.

The data storage 116 is used for storing data. Since the DRAM in the image memory 104 is not provided with a data backup area, a data storage area is provided in the data storage in the present embodiment. It may also be shared with the image memory 104. A data backup can be achieved in the data storage 116. In the present embodiment, the data storage 116 is constituted of a DRAM, but it may also be constituted of a hard disk or a volatile memory.

The digital camera 117 stores an image, taken through a lens, as digital data. It can be connected and can communicate with the PCMCIA I/F controller 115 whereby a data exchange is made possible between the digital camera 117 and the image processing apparatus 100.

The memory card 118 is a data memory medium and can be connected with the image processing apparatus 100. In the present embodiment, the connection is made through a PCMCIA interface, but another interface may also be adopted. An access to the data in the memory card, such as image data or other data, can be made through the PCMCIA I/F controller 115.

In the present embodiment, the USB communication in the recording function utilizes a 1-to-1 connection.

The aforementioned components 101 to 106, 108 to 113 are mutually connected through a CPU bus 121 managed by the CPU 101.

Figure 2:
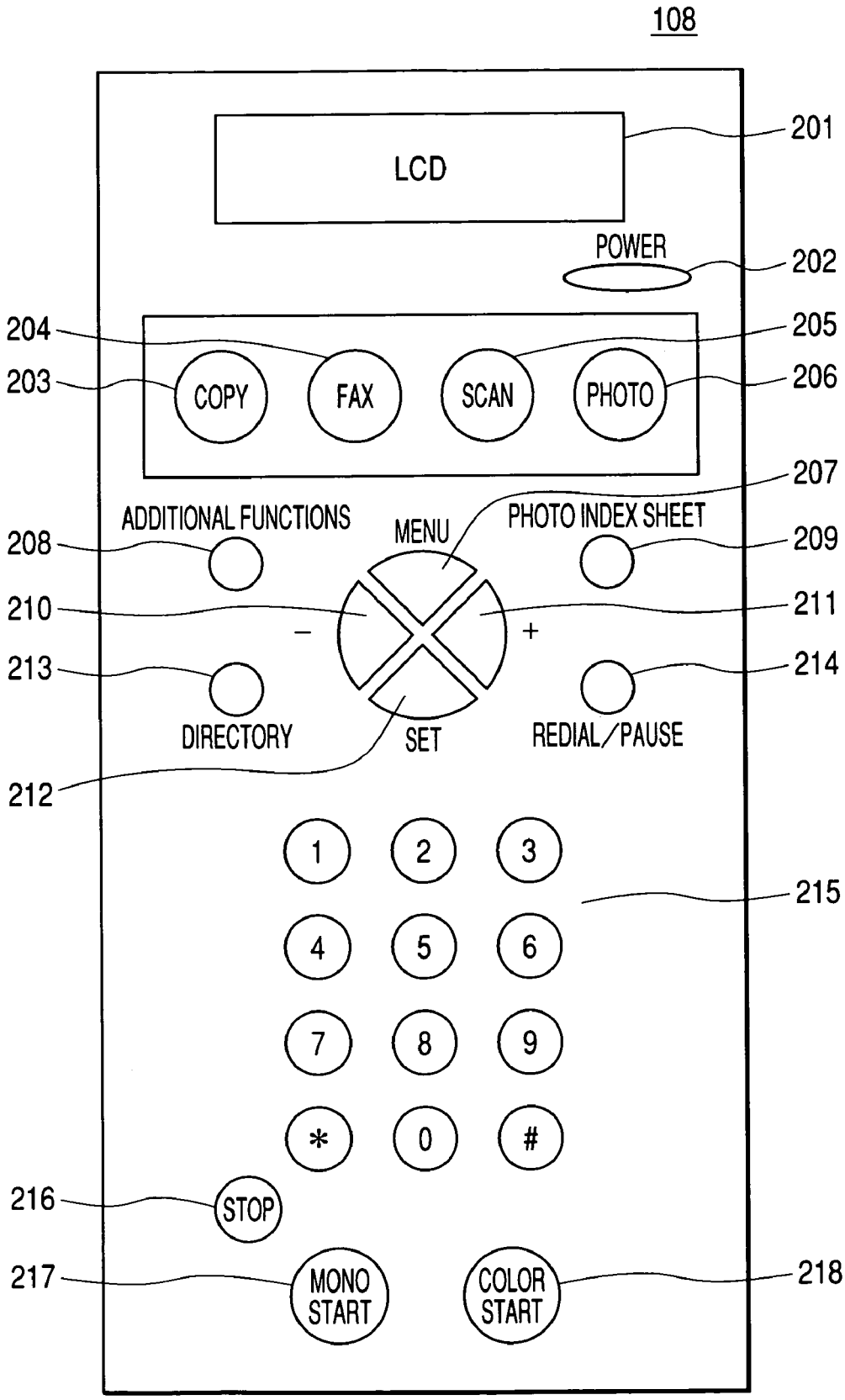
FIG. 2 is a view showing a specific example of an operation/display unit 108 provided in the image processing apparatus 100.

FIG. 2 shows a specific example of the operation/display unit 108 provided in the image processing apparatus 100.

The operation/display unit 108 is provided with an LCD 201, a power supply key 202, a copy mode key 203, a fax mode key 204, a scan mode key 205, a photo mode key 206, a menu key 207, a user set key 208, a photo index sheet key 209, a minus key 210, a plus key 211, a set key 212, a telephone index key 213, a redial key 214, numeral keys 215, a stop key 216, a monochromatic start key 217 and a color start key 218.

The LCD display 201 displays a message, an operation prompt and various information.

The power supply key 202 turns on and off the power supply of the apparatus.

The copy mode key 203 realizes a copying state of the image processing apparatus 100, and, upon depression of the copy mode key 203, sets the image processing apparatus 100 in a copy mode.

The fax mode key 204 realizes a fax state of the image processing apparatus 100, and, upon depression of the fax mode key 204, sets the image processing apparatus 100 in a fax mode.

The scan mode key 205 realizes a scanning state of the image processing apparatus 100, and, upon depression of the scan mode key 205, sets the image processing apparatus 100 in a scan mode.

The photo mode key 206 realizes a state of the image processing apparatus 100 capable of a direct printing based on the data from a digital photo card or a camera, and, upon depression of the photo mode key 206, sets the image processing apparatus 100 in a photo mode.

Each of the copy mode key 203, the fax mode key 204, the scan mode key 205 and the photo mode key 206 constitute an example of mode switch means for switching among plural modes including a standby state.

The menu key 207 displays items for setting a set value at the executing of copying, faxing or direct printing from a card. Set items for execution are displayed on the LCD 201 by a depression of the menu key 207, selected with the plus key 211 and the minus key 210 and the selected item is set by the set key 212.

The user set key 208 displays a screen for registering a set value set by the user in the apparatus. User set items are displayed on the LCD 201 by a depression of the user set key 208, selected with the plus key 211 and the minus key 210 and the selected item is set by the set key 212.

The photo index sheet key 209 shifts to a screen for printing or reading a photo index sheet. When the photo index sheet key 209 is depressed in a state where the memory card 118 is inserted in the image processing apparatus 100, the display shifts to a screen for instructing a printing or a reading of the photo index sheet. The reading or printing can be selected with the plus key 211 or the minus key 210 and set by the set key 212. The photo index sheet will be explained later with reference to FIG. 3.

The minus key 210 and the plus key 211 are used for selection from plural selection items by the user in the menu, user registration, etc., and respectively indicate forward and reverse orders.

The set key 212 is used for determining the selected item. The telephone index key 213 is used for calling a telephone number registered in a telephone index. The redial key 214 upon depression makes a redialing to a last dialed destination.

The numeral keys 215 are a key group used for registering a telephone number, a facsimile number, or a name of the destination, or for setting a copy number or dialing. The stop key 216 is used for terminating a facsimile transmission or reception, a copying or other operations.

The monochromatic start key 217 is used for initiating a monochromatic facsimile transmission or a monochromatic copying. The color start key 218 is used for initiating a color facsimile transmission, a color copying or a color photo printing.

Figure 3:
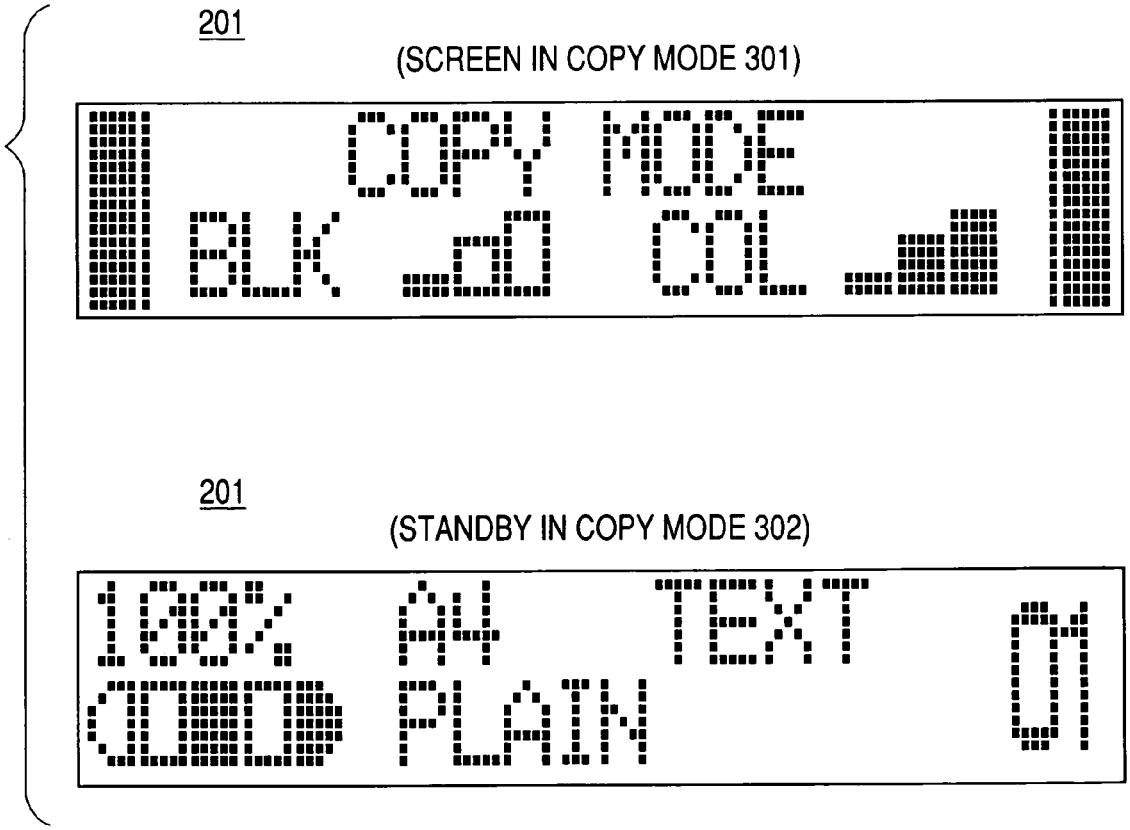
FIG. 3 is a view showing an example of display by an LCD (display unit) 201 used in the image processing apparatus 100 in the foregoing embodiment.

FIG. 3 shows examples of display on the LCD (display unit) 201 used in the image processing apparatus 100.

The LCD 201 is capable of displaying 20 characters in 2 lines, in which a character is displayed by 7 dots in the vertical direction and 5 dots in the horizontal direction, and 20 characters are displayed in a line, and constitutes an example of display means for displaying the mode set in the set mode storage means. Other display means than the LCD 201 may be employed as long as the mode and the residual ink amount can be displayed.

At first, in a copy mode screen 301, a current copy mode is indicated in the upper line of the LCD 201. The user can confirm the currently adopted copy mode by observing the display on the image 301. In the copy mode image 301, the residual ink amount is displayed on the lower line of the LCD 201. BLK indicates a black ink while COL indicates a color ink, each represented in three levels. In the present embodiment, the residual ink amount is indicated in three levels, but the residual ink amount may also be indicated in other number of levels.

When the image processing apparatus 100 is set at the copy mode by the copy mode key 203, a standby image 302 of the copy mode is indicated in the LCD 201 of the display unit 108.

Figure 4:
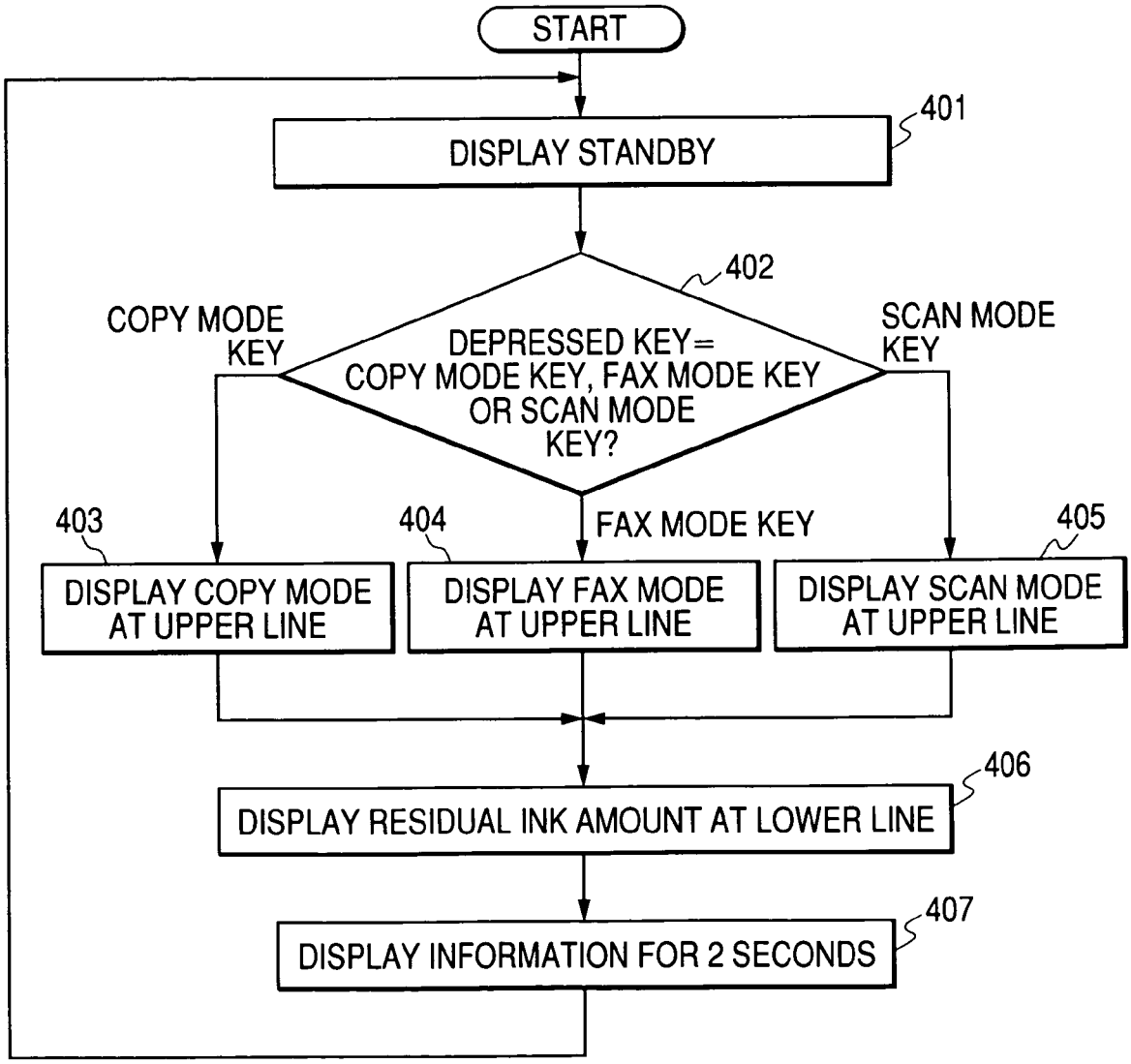
FIG. 4 is a flow chart showing a mode displaying operation on the LCD 201 in the aforementioned embodiment.

FIG. 4 is a flow chart showing a flow chart showing a mode display operation on the LCD 201 in the present embodiment.

At first a step 401 displays a standby state. This is a standby display of a mode in a mode set in following steps.

The standby screen 302 of the copy mode shown in FIG. 3 is displayed when the copy mode is set.

In a step 402, the display is changed in response to a depression of the mode keys 203 to 206. The sequence proceeds to a step 403 in response to the depression of the copy mode key 203, to a step 404 in response to the fax mode key 204, and to a step 405 in response to the scan mode key 205.

At first, when the copy key 203 is depressed (step 403), the copy mode is displayed in the upper line of the LCD 201. When the fax mode key 204 is depressed (step 404), the fax mode is displayed in the upper line of the LCD 201. Also a step 405 displays the scan mode in the upper line of the LCD 201. These steps 403, 404, 405 execute the display in the upper line of the LCD 201, but the display may be executed in another part as long as the mode state can be displayed.

After the step 403, 404 or 405, a step 406 displays the residual ink amount in the lower line of the LCD 201. Such display in the lower line allows to simultaneously display the mode information and the residual ink amount information on the same screen.

A step 407 executes the display for 2 seconds. A certain time (2 seconds) is selected for facilitating the recognition by the user of the content determined in the steps 403 to 406. Thus the user can recognize both the displays of the mode and the residual ink amount, even though they are simultaneously displayed. In the present embodiment, the mode and the residual ink amount are displayed for 2 seconds, but another time may also be selected for the display.

In the present embodiment, in a state where a certain mode is set, when such certain mode is set by the mode setting means, such certain mode and the residual ink amount are displayed again.

Figure 5:
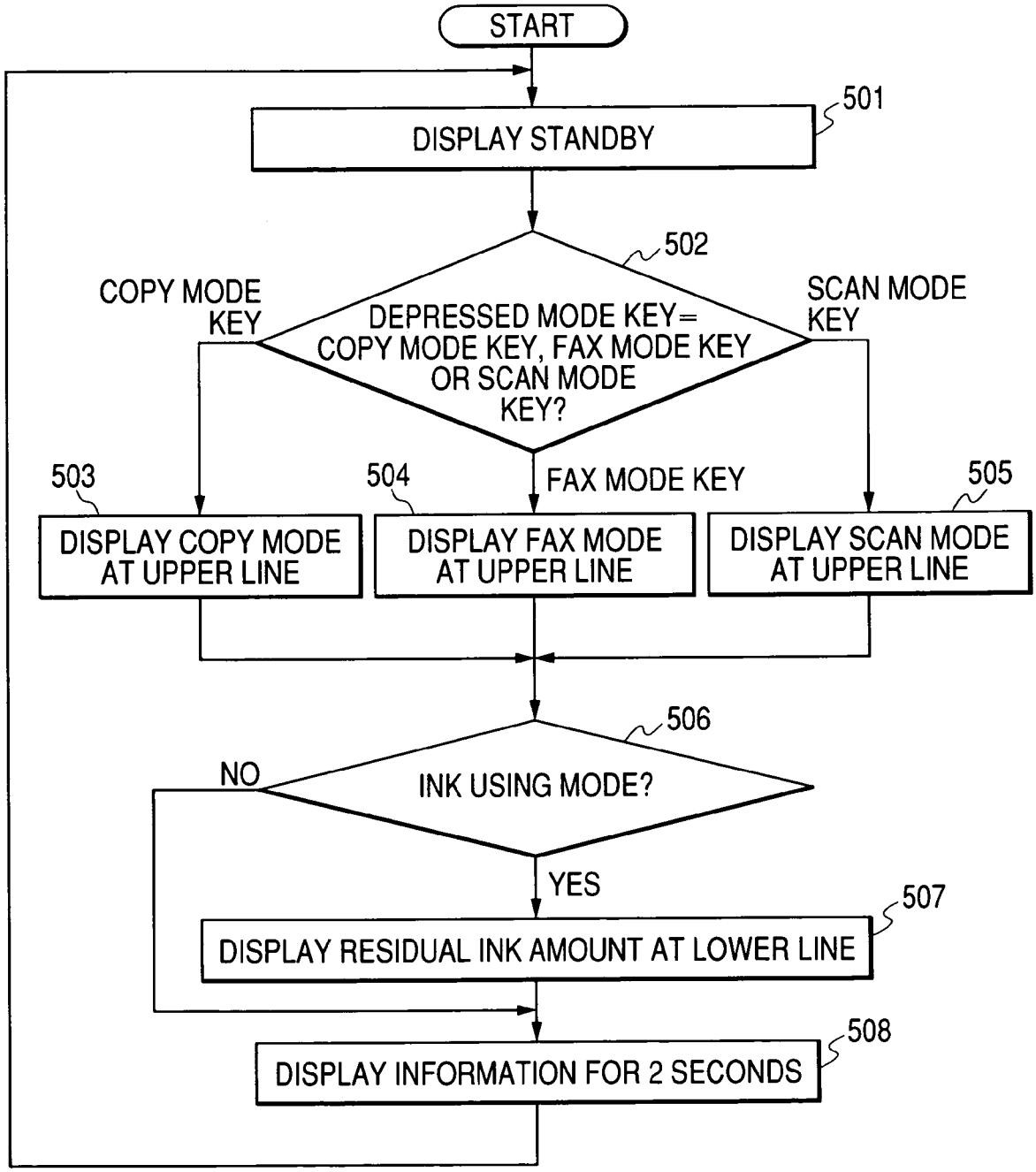
FIG. 5 is a flow chart showing a mode displaying operation on the LCD 201 in the aforementioned embodiment.

FIG. 5 is a flow chart showing an operation of mode display on the LCD 201 in the present embodiment.

At first a step 501 displays a standby state. This is a standby display of a mode in a mode set in following steps.

The standby screen 302 of the copy mode shown in FIG. 3 is displayed when the copy mode is set.

In a step 502, the display is changed in response to a depression of the mode keys 203 to 206.

In case the copy mode key 203 is depressed in the step 502, the sequence proceeds to a step 503. Also the sequence proceeds to a step 504 in response to the fax mode key 204, and to a step 505 in response to the scan mode key 205.

At first, when the copy key 203 is depressed, the step 503 displays the copy mode in the upper line of the LCD 201. When the fax mode key 204 is depressed, the step 504 displays the fax mode in the upper line of the LCD 201.

Also a step 505 displays the scan mode in the upper line of the LCD 201. These steps 503, 504, 505 execute the display in the upper line of the LCD 201, but the display may be executed in another part as long as the mode state can be displayed.

After the step 503, 504 or 505, a step 506 discriminates whether the selected mode is an ink using mode. The sequence proceeds to a step 507 in case of an ink using mode, or to a step 508 in case of an ink non-using mode.

A step 507 displays the residual ink amount in the lower line of the LCD 201. Such display in the lower line allows to simultaneously display the mode information and the residual ink amount information on the same screen. A step

508 executes the display of the mode information and the residual ink amount for 2 seconds. A certain time (2 seconds) is selected for facilitating the recognition by the user of the content determined in the steps 503 to 505 and 507. Thus the user can recognize both the displays of the mode and the residual ink amount, even though they are simultaneously displayed. In the present embodiment, the mode and the residual ink amount are displayed for 2 seconds, but another time may also be selected for the display.

In this manner the residual ink amount is displayed on in a mode utilizing the ink, so that the mode switching keys can be utilized, not only as keys for mode switching but also as keys for confirming the residual-ink amount.

Thus the foregoing embodiment is an example of an image processing apparatus including mode switch means which executes switching among plural modes each having a standby state, set mode storage means which stores a set mode, display means which displays a mode set in the set mode storage means, printing means which prints data such as an image or a text, residual ink amount detection means which detects a residual ink amount, and display control means which causes the display means to display the set mode and the residual ink amount detected by the ink amount detection means when the mode switch means switches the mode.

Also the foregoing embodiment is an example of an image processing apparatus which does not display the residual ink amount in a mode not using the ink.

In such embodiment, in a standby state of a certain mode, the residual ink amount is displayed by a depression of a key for switching to such mode instead of a key for switching to another mode, so that the user can know the residual ink amount by a simple operation.

For example, in case the user desires a copying operation, upon finding the copy mode on the display unit, the user can execute the copying operation without a mode switching, and, in case of confirming the residual ink amount, a depression of the copy mode key, even though the copy mode is already set, provides the display of the residual ink amount, whereby the residual ink amount can be easily confirmed before the start of the copying operation.

The present invention provides an effect that, in a standby state of a certain mode, a depression of a key for switching to such certain mode instead of a key for switching to another mode displays the residual ink amount, whereby the user can know the residual ink amount with a simple operation, and an effect that a hardware such as a particular switch is not required for displaying the residual ink amount.

This application claims priority from Japanese Patent Application No. 2003-332506 filed on Sep. 24, 2003, which is hereby incorporated by reference herein.

What is claimed is:

1. An image processing apparatus comprising:

mode switch means which executes switching among plural modes, each having a standby state;

set mode storage means which stores a set mode;

display means which displays a mode set in said set mode storage means;

printing means which prints data such as an image or a text;

residual ink amount detection means which detects a residual ink amount; and display control means which causes the display means to display the residual ink amount detected by said residual ink amount detection means when a copy mode key is depressed while a copy mode is already set and is displayed.

2. An image processing apparatus according to claim 1, wherein said display control means causes said display means to not display the residual ink amount in a case of the set mode being a mode not using the ink.

3. A display control method for an image processing apparatus comprising:

a mode switch step which executes switching among plural modes, each having a standby state;

a set mode storage step which stores a set mode;

a display step which displays a mode set in said set mode storage step on a display unit;

a printing step which prints data such as an image or a text;

a residual ink amount detection step which detects a residual ink amount; and a display control step which causes the display unit to display the residual ink amount detected by said residual ink amount detection step when a copy mode key is depressed while a copy mode is already set and is displayed.

4. A display control method according to claim 3, wherein said display control step causes the display unit to not display the residual ink amount in a case of the set mode being a mode not using the ink.

* * * * *